United States Patent [19]

Landa et al.

[11] Patent Number: 5,025,290

[45] Date of Patent: Jun. 18, 1991

[54] PULSED VOLTAGE DEVELOPMENT ELECTRODE CLEANER

[75] Inventors: Benzion Landa, Edmonton, Canada; Yakov Krumberg; Yossef Adam, both of Rehovot, Israel

[73] Assignee: Savin Corporation, Stamford, Conn.

[21] Appl. No.: 349,961

[22] Filed: May 8, 1989

Related U.S. Application Data

[63] Continuation of Ser. No. 22,245, Mar. 5, 1987, abandoned.

[51] Int. Cl.[5] ..... G03G 15/06

[52] U.S. Cl. ..... 355/265; 118/647; 355/246

[58] Field of Search ..... 355/261, 262, 263, 264, 355/265, 246, 256; 118/647, 648, 649, 650, 659; 430/103, 125

[56] References Cited

U.S. PATENT DOCUMENTS

| | | | |
|---|---|---|---|
| 3,866,574 | 2/1975 | Hardenbrook et al. | 355/3 DD X |
| 4,045,217 | 8/1977 | Fujimura et al. | 96/1 LY |
| 4,168,329 | 9/1979 | Miyakawa et al. | 355/10 X |
| 4,247,195 | 1/1981 | Okamoto et al. | 355/14 D |
| 4,320,958 | 3/1982 | Fantuzzo | 355/3 DD |
| 4,322,488 | 3/1982 | Kuehnle et al. | 430/103 |
| 4,423,134 | 12/1983 | Miyakawa et al. | 118/647 X |
| 4,479,709 | 10/1984 | Syukuri et al. | 355/15 |
| 4,530,595 | 7/1985 | Itaya et al. | 355/15 |
| 4,615,613 | 10/1986 | Garsin | 355/15 |
| 4,647,186 | 3/1987 | Armstrong et al. | 118/652 X |

FOREIGN PATENT DOCUMENTS

| | | | |
|---|---|---|---|
| 0139555 | 10/1979 | Japan | 355/10 |
| 0155045 | 12/1979 | Japan | 355/15 |
| 0082277 | 5/1983 | Japan | 355/10 |

*Primary Examiner*—A. T. Grimley
*Assistant Examiner*—William J. Royer
*Attorney, Agent, or Firm*—Kenyon & Kenyon

[57] ABSTRACT

A voltage waveform is applied to a development electrode in an electrophotographic apparatus to assist in the cleaning of the development electrode without degrading the photoconductor surface with excessive toner particles. The waveform establishes a bias voltage of one polarity on which are impressed pulses of the other polarity of sufficient amplitude and duration to dislodge charged toner particles from the surface of the development electrode, but insufficient to move the toner particles to the photoconductor surface.

17 Claims, 3 Drawing Sheets

PULSED VOLTAGE DEVELOPMENT ELECTRODE CLEANER

This application is a file wrapper continuation of application Ser. No. 022,245, filed Mar. 5, 1987, now abandoned.

BACKGROUND OF THE INVENTION

This invention relates generally to a liquid electrophotographic apparatus, and more specifically, to improvements in cleaning a development electrode in a liquid electrophotographic apparatus.

A typical liquid electrophotographic apparatus includes a photoconductor and a development electrode. The development electrode provides an electrical potential which, together with the potential on the photoconductor, provides an electrical field which serves two functions: first, the electrical field urges toner toward the latent image on the photoconductor, secondly, the electrical field urges toner from the non-image areas of the photoconductor toward the electrode and thereby cleans the background (i.e. non-image) areas on the photoconductor. Development electrodes have achieved widespread acceptance in the electrophotographic industry because they can provide a continuous, even coat of toner to the entire image area, including the solid image areas.

One disadvantage of the prior art biased development electrode is that the development electrode itself gets plated with toner while it is performing its cleaning function, thereby rendering it coated with a thick layer of toner particles and impeding the performance of its aforementioned functions. In the prior art, the development electrode has been cleaned by reversing the electrical bias on the development electrode between copies and thereby repelling the charged toner particles toward the surface of the photoconductor. Thus, in a known liquid electrophotographic apparatus, when a latent image on the photoconductor surface is passing the development electrode, an electrical potential having the same polarity as the photoconductor is applied to the development electrode. The potential applied to the development electrode is such that it attracts toner particles from background areas of the photoconductor but is not strong enough to remove toner particles from the image areas on the photoconductor surface. When the image area on the photoconductor has passed from the development electrode region, the bias on the development electrode is changed so as to repel the charged toner particles which had been deposited on the development electrode pushing them back onto the photoconductor surface. Thus, the known cleaning method is based on the fact that the toner deposited on the development electrode can be removed by changing the attractive force to a repulsive force. The toner particles are subsequently removed from the photoconductor surface at a cleaning station located further downstream in the electrophotographic cycle with respect to the movement of the photoconductor.

Prior art systems and methods for cleaning a development electrode suffer several disadvantages. First, the cleaning station has a work very hard to remove the large quantity of toner which was repelled from the development electrode and placed on the photoconductor surface. Secondly, in the prior art systems, it is impossible to run copies continuously, because those systems require a dead band (i.e. an area without an image) on the photoconductor surface between copies. This is especially disadvantageous in an electronic printer or in a very high speed web copier where there is no dead band and copies advantageously follow one immediately after another.

Furthermore, by requiring the cleaning station to remove a large quantity of toner from the photoconductor surface, prior art systems make the changing of toner colors very cumbersome and time consuming.

OBJECTS OF THE INVENTION

It is therefore an object of the present invention to improve the design of electrophotographic apparatus by improving the development electrode so that the development electrode remains cleaner during the electrophotographic process.

It is a further object of the present invention to provide an improved development electrode which greatly reduces the amount of residual toner remaining on the photoconductor surface after that surface has passed through the development electrode region.

It is a further object of the present invention to provide an electrophotographic apparatus having a photoconductor surface which can be run continuously without the need for a dead band between copies.

It is a further object of the present invention to provide a new method of cleaning a biased development electrode.

It is a further object of the present invention to provide for continuous cleaning of the development electrode without coating the photoconductor surface with a large quantity of toner.

It is yet a further object of the present invention to provide an improved development electrode which can be used with existing conventional photoconductors in electrophotographic apparatuses.

SUMMARY OF THE INVENTION

The present invention attains these objects with an electrophotographic apparatus having a photoconductor and a development station with a development electrode spaced from the photoconductor surface. Charged toner particles are supplied to the photoconductor surface at a location between the photoconductor surface and the development electrode. A pulse is applied to the development electrode. The pulse is sufficient to dislodge the charged toner particles from the development electrode but is insufficient to coat the charged particles onto the photoconductor surface.

DETAILED DESCRIPTION

Figure 1:
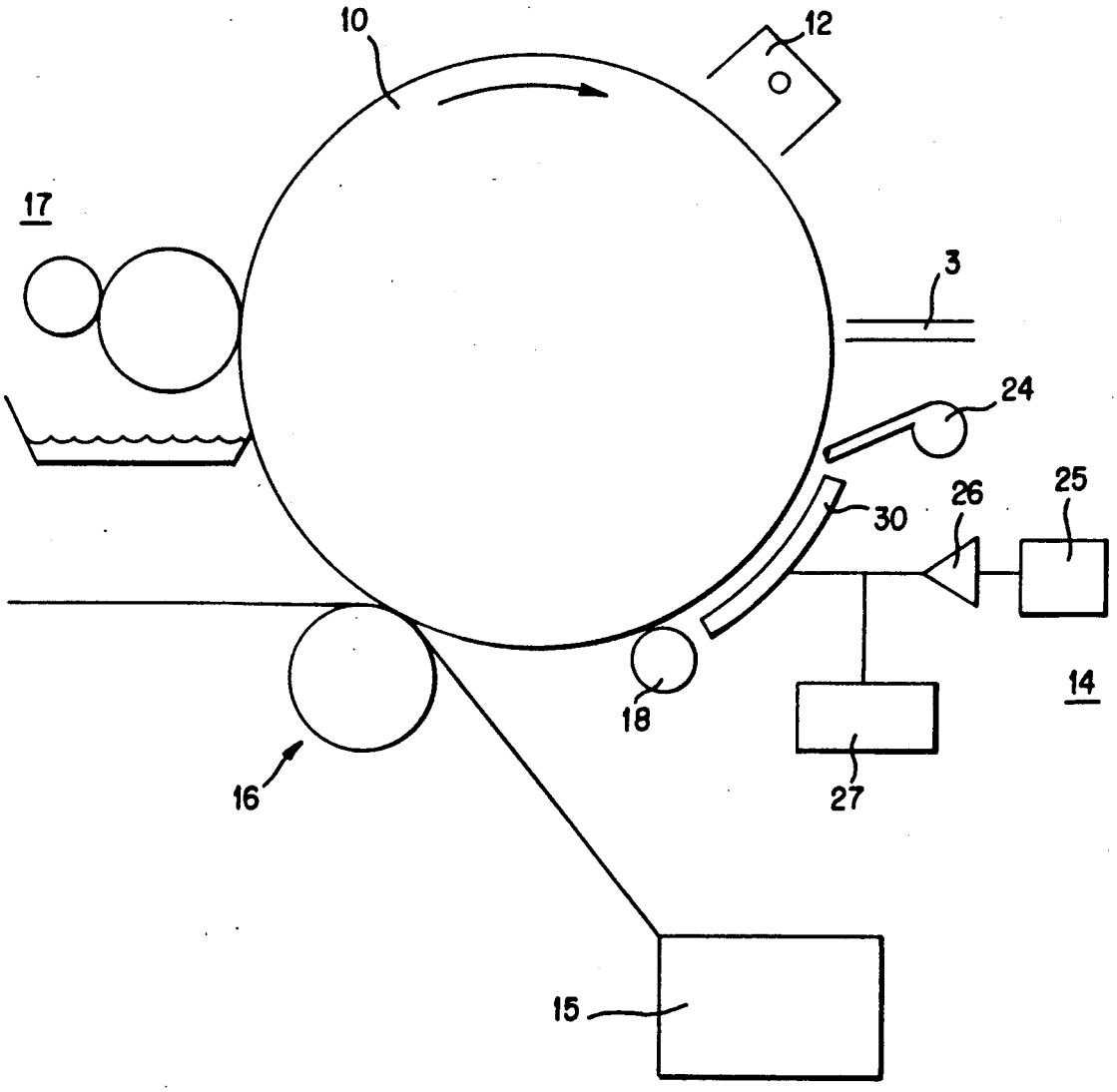
FIG. 1 schematically illustrates one embodiment of the present invention.

FIG. 1 schematically illustrates an electrophotographic apparatus having a photoconductor drum 1 which rotates clockwise, wherein a charge is supplied to the surface of photoconductor drum 10 by a charging corona 12. The charged surface of photoconductor drum 10 is then exposed to an image forming means 13, such as an image light source, which provides a latent image to the charged surface of the photoconductor drum 10. The latent image is supplied with charged toner liquid at development station 14 by pump 24 which pumps a charged toner liquid into the gap between the development electrode 30 and the photoconductor surface. It will be appreciated that the toner fluid flow can be adjusted as desired but, generally, the viscosity of the liquid toner solution and the discharge rate of the pump are selected to create a laminar flow of liquid developer solution moving at an average speed similar to that of the photoconductor 10. As the electrophotographic cycle continues, the developed image is metered by metering roller 18 and the image is transferred to a sheet of blank paper from paper supply 15 at transfer station 16. The sheet is then carried toward the delivery station (not shown) of the electrophotographic apparatus. The image transfer at transfer station 16 is not 100% efficient, therefore, residual toner remains on the photoconductor and subsequent cleaning of the photoconductor surface is necessary. As photoconductor drum 10 rotates, cleaning station 17 removes residual toner remaining after the incomplete transfer at transfer station 16 from the surface of photoconductor drum 10.

Figure 2:
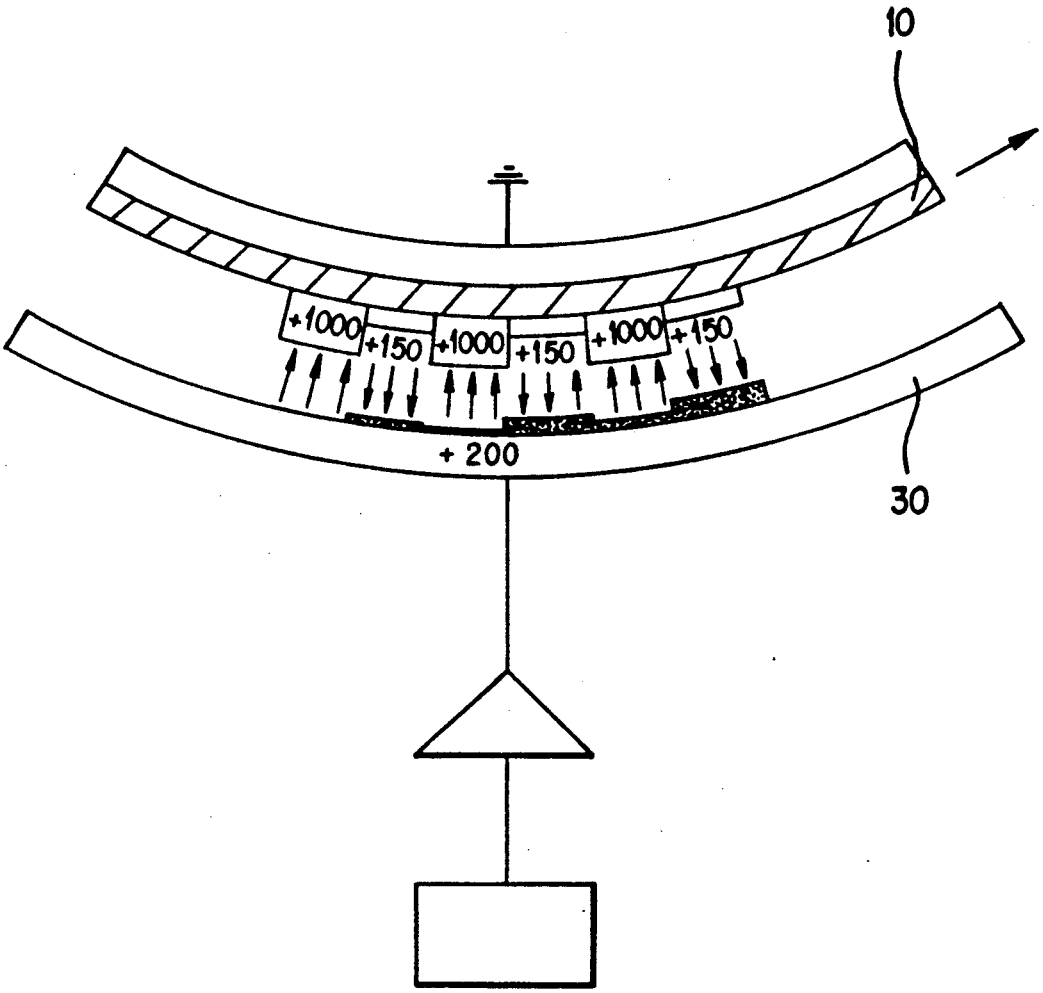
FIG. 2 illustrates the electrical field in the development electrode region between pulses.

After a latent image has been formed a residual potential usually remains on the photoconductor. FIG. 2 generally illustrates an electrostatic latent image on the photoconductor, where the image areas are charged to +1000 volts and the residual potential is +150 volts. By biasing the development electrode with the same polarity but a greater potential than the residual potential on the photoconductor surface, the development of background on the photoconductor can be minimized. When an electrical potential having the same polarity as the photoconductor is being applied to the development electrode, as illustrated in FIG. 2, the toner particles in the non-image areas are attracted to and move toward the development electrode. Due to the fact that the non-image areas are generally larger than the image areas, the toner deposition can accumulate and the electrode can become contaminated. A thick deposited layer of toner particles on the development electrode 30 will adversely alter the electrical field in the development zone and can partly close the gap between the development electrode and the photoconductor.

In accordance with the present invention, as illustrated in FIG. 1, a voltage which is periodically reversed for a short period in a pulsed manner is applied to development electrode 30. The applied potential has the same polarity as the charged toner particles and is sufficient to dislodge the charged toner particles which have accumulated on the development electrode. The pulse is not, however, of sufficient amplitude and/or duration to propel the charged toner particles all the way back onto photoconductor drum 10. In this fashion, the dislodged toner particles will be carried away from the development electrode by the preferably laminar flow of toner liquid described above.

As generally illustrated in FIG. 1, a signal generator 25 and an amplifier 26 are connected to development electrode 30 to supply a pulsed voltage. It will be appreciated by those skilled in the art that the duration (duty cycle) and amplitude of the pulse which dislodges the toner particles from the development electrode are limited to certain ranges which will depend upon other existing parameters in the development region 14. If the duty cycle of the pulse for a given amplitude is too short, the pulse will be insufficient to dislodge the charged toner particles and development electrode 30 will remain "dirty". If, however, the duty cycle is too long for the selected amplitude of the pulse, the charged toner particles will be undesirably coated onto the photoconductor surface, will degrade the image and will have to be removed later in the electrophotographic cycle. It will be appreciated by those skilled in the art that the desired duty cycle will be dependent upon the amplitude of the pulse supplied to the development electrode 30.

In the illustrated embodiment of the present invention, a pulsed voltage is impressed upon a constant DC bias voltage from DC supply source 27. The DC bias voltage has the same polarity as the photoconductor. The combined DC supply voltage and superimposed pulse source provide a voltage waveform having a bias value which attracts the charged toner particles from the background areas, and a pulse, having the same polarity as the charged toner particles, which dislodges the charged toner particles from the development electrode surface. The dislodged toner particles can then be swept away by the toner liquid flow discussed above.

Alternatively, the DC bias voltage can be eliminated and a waveform having the desired characteristics can be supplied. It will be appreciated by those skilled in the art that when such a waveform is utilized, the waveform can be supplied to the development electrode using a conventional signal generator, e.g., a square wave generator and amplifier.

It will be readily appreciated that when toner fluids employing toner particles having negative charges are utilized, the pulses will be negative. Alternatively, when a charged toner fluid employing positively charged particles is utilized, the pulse will be positive.

The working range of the waveform wave supplied to the development electrode 30 is influenced by the following conditions:

1) toner conductivity;
2) toner concentration;
3) distance between electrode and photoconductor;
4) photoconductor residual potential; and
5) velocity of the toner flow.

It has been determined that for a 0.6 mm gap between the development electrode and photoconductor, with an initial photoconductor potential of 1400 V., using toner MB 101 having a conductivity of 15 $p\upsilon cm^{-1}$ (picomho/cm) in a toner fluid having a concentration of 1.5%, a toner fluid flow of 25 cm/sec, and a frequency of 10 Hz, that a positive bias of +200 V and a negative pulse of −1000 V for between 8.5 msec. to 10 msec. provided the desirable results. For the same conditions, a pulse with a repetition frequency of 100 Hz for between about 1.5 msec. to about 1.7 msec. was sufficient.

As stated above, if the duration of the pulse is too long or the pulse amplitude is too high, the toner particles will leave the development electrode, reach the photoconductor surface and degrade the image background. On the other hand, if the pulse duration is too short or the amplitude is too low, the development electrode will not be cleaned.

Figure 3:
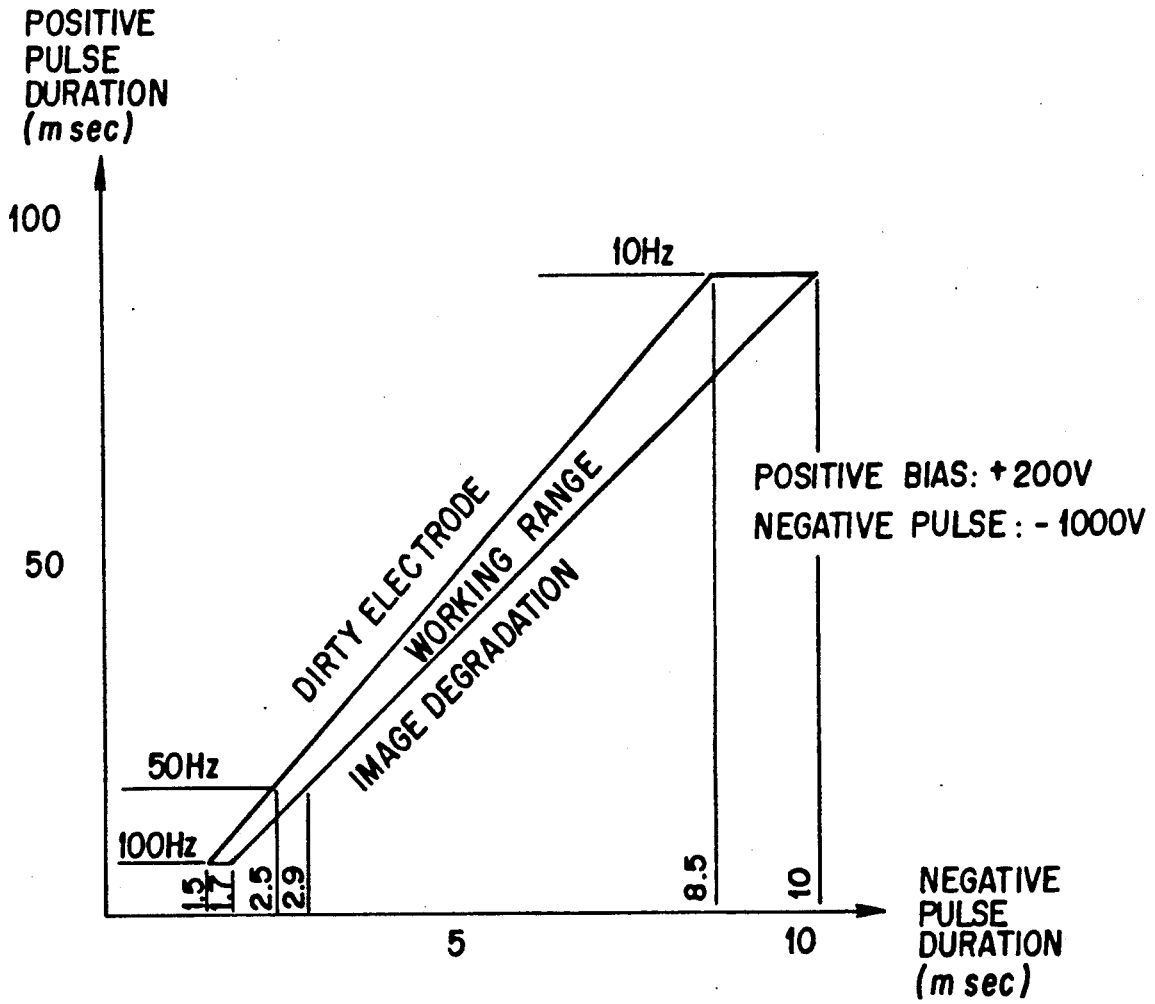
FIG. 3 graphically illustrates the duration of the duty pulse under an exemplary set of conditions described below.

FIG. 3 depicts the working range for three different frequencies, 10, 50 and 100 Hz using the same pulse amplitude: a positive bias of +200 V and a negative −1000 V cleaning pulse. The toner used was MB 101 with conductivity of 15 $p\upsilon cm^{-1}$ (picomho/cm). The distance between the development electrode and photoconductor surface was 0.6 mm and the initial photoconductor potential was 1400 V. Pulses were produced by a KEPCO BOP 1000 M bipolar operational power supply/amplifier controlled by a Krohn-Hite 2200 pulse generator. As can be seen from FIG. 3, as the frequency increases, the working range becomes narrower. FIG. 3 illustrates the fact that at higher pulse frequencies, the electrode cleaning parameters are more sensitive to changes in the development conditions.

It will therefore be appreciated that the present invention cleans the development electrode with a voltage supplied repulsive force but does not result in degradation of the image.

What is claimed is:

1. In an electrophotographic apparatus having a photoconductor capable of carrying a latent electrostatic image and a development station with a development electrode spaced from said photoconductor, wherein charged toner particles are supplied to said photoconductor by said development electrode the improvement comprising:

means for supplying an electrical pulse to said development electrode during the development of said latent electrostatic image wherein said pulse is sufficient to dislodge said charged toner particles from the surface of said development electrode and said pulse being insufficient to coat said charged particles onto said photoconductor.

2. An electrophotographic apparatus as in claim 1 wherein said pulse supplying means supplies a pulsed voltage impressed over a constant DC bias to said development electrode.

3. An electrophotographic apparatus as in claim 1 wherein said pulse supplying means supplies a negative pulse to said development electrode.

4. A method of continuously cleaning a development electrode in an electrophotographic apparatus having a photoconductor having a surface, wherein said apparatus utilizes a toner fluid having charged toner particles and said surface of said photoconductor has a latent electrostatic image with a potential of a certain polarity comprising the step of:

applying an electrical pulse to said development electrode during the development of said latent electrostatic image and wherein said electrical pulse has an amplitude sufficient to dislodge charged toner particles from the surface of said development electrode but is insufficient to propel said charged particles onto said photoconductor.

5. An electrophotographic apparatus having a photoconductor capable of carrying a latent electrostatic image, a development station with a development electrode spaced from said photoconductor, charged toner particles for developing the image, means for continuously cleaning said development electrode, said cleaning means supplying a repetitive electrical pulse to said development electrode during the development of said latent electrostatic image sufficient to dislodge said charged toner particles from said development electrode and said pulse being insufficient to deposit said charged toner particles onto said photoconductor surface.

6. An electrophotographic apparatus having a photoconductor capable of carrying a latent electrostatic image, a development electrode, means for supplying a flow of developer liquid having charged toner particles along said development electrode, and means for continuously cleaning said development electrode wherein said cleaning means supplies repetitive electrical pulses to said development electrode during the development of said latent electrostatic image, and wherein said pulses are sufficient to dislodge said toner particles from the surface of said development electrode and insufficient to transfer said particles to said photoconductor surface.

7. An electrophotographic apparatus as in claim 6 wherein said supplying means provides a laminar flow of developer liquid on the surface of said development electrode.

8. An electrophotographic apparatus capable of continuous copying comprising a photoconductive surface capable of carrying a latent electrostatic image, a development electrode spaced from said photoconductive surface, charged toner particles for developing said latent image, and means for continuously cleaning said development electrode during the development of said latent electrostatic image by supplying repetitive electrical pulses to said development electrode, said pulses sufficient to dislodge said charged toner particles from the surface of said development electrode but insufficient to transfer said toner particles to said photoconductive surface.

9. An apparatus having a latent electrostatic image carried on a substrate and a development electrode spaced from said substrate wherein charged toner particles are transferred to said substrate comprising means for supplying an electrical pulse to said development electrode during the development of said latent electrostatic image wherein said pulse is sufficient to dislodge said charged toner particles from the surface of said development electrode and said pulse is insufficient to transfer said particles onto said substrate.

10. A method of continuously cleaning a development electrode in an electrophotographic apparatus having a photoconductor having a surface capable of bearing a latent electrostatic image, wherein said apparatus utilizes a toner fluid having charged toner particles and said development electrode is provided with a development voltage, said method comprising the steps of:

applying a second voltage to said development electrode during the development of said image, wherein said second voltage has an amplitude and duration sufficient to dislodge charged toner particles from the surface of said development electrode but is insufficient to propel said charged particles onto said photoconductor, and wherein the net voltage of said development electrode when said second voltage is provided is of polarity opposite to said development voltage.

11. The method of claim 10 wherein said second voltage is provided at a frequency of 10 Hz for between about 8.5 msec to about 10 msec.

12. The method of claim 10 wherein said second voltage is provided at a frequency of 50 HZ for between about 2.5 msec to about 2.9 msec.

13. The method of claim 10 wherein said second voltage is provided at a frequency of 100 Hz for between about 1.5 msec to about 1.7 msec.

14. Apparatus for the development of an electrostatic latent image on an image bearing photoconductive substrate, said apparatus comprising:

a development electrode adjacent said substrate;

means for providing a development voltage of a given polarity to said development electrode to develop said image; and means for providing a second voltage to said development electrode during development of said image to provide cleaning of said electrode, wherein the net voltage of said development electrode when said second voltage is provided is of polarity opposite to said development voltage.

15. The apparatus of claim 14 wherein said second voltage is provided at a frequency of 10 Hz for between about 8.5 msec to about 10 msec.

16. The apparatus of claim 14 wherein said second voltage is provided at a frequency of 50 Hz for between about 2.5 msec to about 2.9 msec.

17. The apparatus of claim 14 wherein said second voltage is provided at a frequency of 100 Hz for between about 1.5 msec to about 1.7 msec.

* * * * *